United States Patent [19]

Young et al.

[11] Patent Number: 4,611,513

[45] Date of Patent: Sep. 16, 1986

[54] OPEN ACCESS STUD GRIPPING TOOL

[76] Inventors: Richard H. Young, 212 Andover Rd., Billerica, Mass. 01821; Edward T. McLaughlin, 21 Concord St., Wilmington, Mass. 01887

[21] Appl. No.: 799,591

[22] Filed: Nov. 19, 1985

[51] Int. Cl.[4] ..... B25B 13/50

[52] U.S. Cl. ..... 81/53.2; 279/55

[58] Field of Search ..... 81/53.2, 59.1; 279/22, 279/30, 55, 58, 1 TE

[56] References Cited

U.S. PATENT DOCUMENTS

| | | | |
|---|---|---|---|
| 892,408 | 7/1908 | Custer | 81/59.1 |
| 2,986,248 | 5/1961 | Rock | 192/44 |
| 3,123,169 | 3/1964 | Young et al. | 192/44 |
| 3,204,496 | 9/1965 | Ingram | 81/59.1 |
| 3,414,096 | 12/1968 | Reed | 192/44 |
| 3,889,557 | 6/1975 | Young | 81/53.2 |

*Primary Examiner*—James L. Jones, Jr.
*Attorney, Agent, or Firm*—Donald W. Meeker

[57] ABSTRACT

Stepped roller pins roll within stepped lobes formed around the interior wall of a hollow cylindrical casing. A hollow cylindrical retainer or simple ring retainer hook into a recessed groove around the middle of the roller and interact with ridges or grooves in the casing to retain the rollers within the lobes. The retainer fits within the limits of movement of a larger diameter section of the roller so that maximum contact is made between the rollers and a smooth stud shaft which is encircled by the casing to any desired extent. The rollers move along the lobes until they lock tight to grip the stud shaft for threading or unthreading. The casing is provided with wrench gripping faces around the exterior. A wrench grips the casing from the side to operate it leaving both ends of the casing open to admit the stud shaft.

11 Claims, 5 Drawing Figures

OPEN ACCESS STUD GRIPPING TOOL

BACKGROUND OF THE INVENTION

1. Technical Field

The present invention relates to stud gripping tools for removing or installing the stud and in particular to a stud gripping tool employing rolling pins on lobe surfaces with open access through the tool head for admitting and gripping a smooth stud shaft at any point along its length.

2. Background Art

Most tools for gripping screw-in connectors are primarily designed for engagement with a head on a bolt or screw rather than the smooth cylindrical shaft of the stud. Shaft gripping tools tend to be complex and too large to fit into tight locations.

Most other stud gripping tools are complex have devices at the end of the tool for retaining the gripping means, thereby recessing the working components of the tool interiorly of the retaining means precluding any gripping action at the end of the tool.

Present stud gripping tools, including applicant Young's tool described in his U.S. Pat. No. 3,889,557, generally utilize a handle, such as a socket wrench handle, which attaches to the top of the gripping head, thereby blocking access at the top of the head to prevent the stud from passing completely through the head and thereby limiting contact of the gripping tool to a small portion of the stud shaft, or the retaining means blocks through passage of the stud.

DISCLOSURE OF INVENTION

Providing three simple components: a stepped roller, mating stepped lobular cam surfaces and a simple retaining means creates a compact and simple means for removing and installing studs by gripping the smooth shaft of the stud regardless of how tight the access space might be.

Using a simple retaining device, such as a ring or a thin-walled cylinder installed adjacent to a smaller diameter section of the roller within the boundary limits of the larger diameter section of the roller, permits full access of the larger diameter section of the roller to the shaft inserted into the stud gripping head. A shaft nearly equal in diameter to the working boundary limits of the large diameter sections of the rollers may be gripped utilizing the full power with maximum contact of the rollers on the shaft.

Having the retaining means recessed out of the way within the boundary limits of the working sections of the rollers and providing a series of external flat surfaces, such as hexagonal faces, around the invention at one end enables use of the invention with a standard wrench around the perimeter of the casing, and thereby leaves the central axis of the invention completely open so that the invention may fit over a stud and slide down the stud shaft to any point on the shaft for application of the gripping force.

Having the retaining means recessed at the handle end of the invention permits the working ends of the rollers to extend to the very end of the casing, so that the invention can grip even at the very end of the tool and thereby provide maximum gripping power on a stud even close to the surface to which the stud is attached.

Usng a ring retaining means fitting into a central groove in each roller with a protruding wall ring around the casing enables the rollers to be the same size on both ends of the casing and thereby creates twice the gripping contact and twice the power.

BRIEF DESCRIPTION OF THE DRAWINGS

These and other details and advantages of our invention will be described in connection with the accompanying drawings, which are furnished only be way of illustration and not in limitation of the invention, and in which drawings.

BEST MODE FOR CARRYING OUT THE INVENTION

Figure 1:
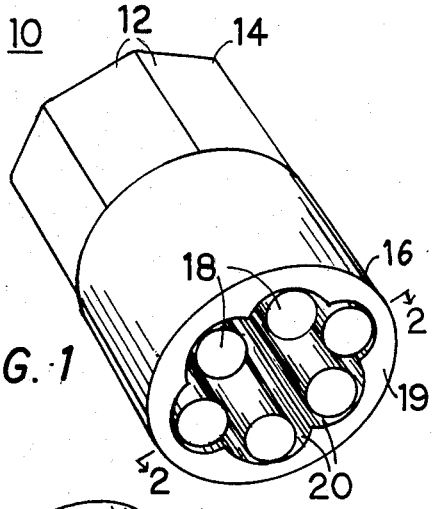
FIG. 1 is a perspective view of the preferred embodiment of the stub gripping tool.
Figure 2:
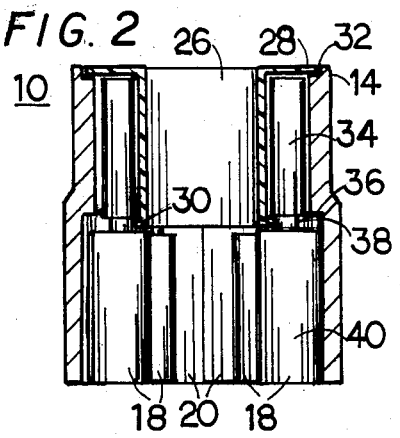
FIG. 2 is a cross-sectional view of the preferred embodiment taken through 2—2 of FIG. 1, showing the stepped rollers and a double-lipped cylindrical retaining means.
Figure 3:
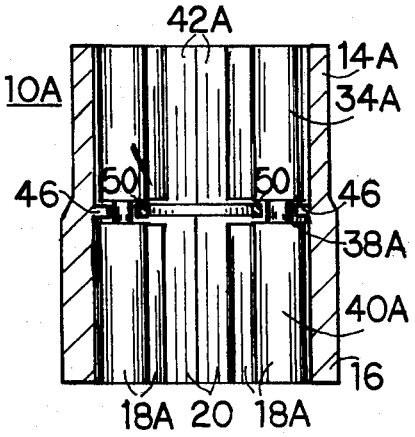
FIG. 3 is a cross-sectional view of an alternate embodiment of the invention having a ring retaining means and a roller of equal diameter on both ends.
Figure 4:
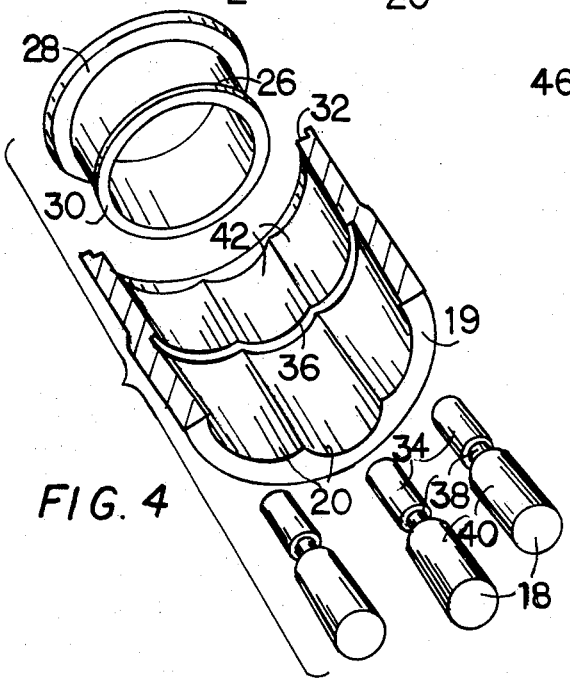
FIG. 4 is a broken perspective view in partial section of the components of the preferred embodiment of the gripping tool aligned for assembly.
Figure 5:
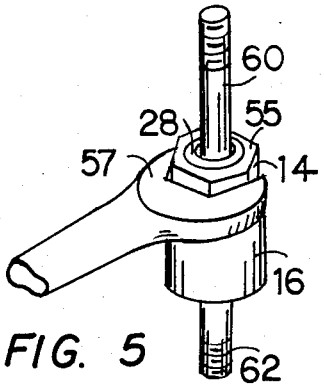
FIG. 5 is a perspective view of the gripping tool applied to a smooth cylindrical stud shaft and utilizing an open-end wrench for turning the gripping tool.

In FIGS. 1, 2 and 3 the gripping tool 10 comprises a hollow cylindrical casing having a handle portion 14 with means to turn the casing, such as the hexagonal faces 12 around the casing exterior to receive a standard wrench 57, as seen in FIG. 5. Opposite the handle end is the working end 16 which may be smooth or have any desired configuration around the exterior.

Interiorly of the casing a series of paired stepped lobes 20 and 42 are formed into the interior surfaces of the casing, each pair extending longitudinally from the working end to the handle end of the casing. Each lobe pair receives a stepped roller 18. A larger diameter working end 40 rolls within the working lobe 20 and the smaller diameter retained end 34 rolls within a smaller lobe 42 at the handle end of the casing. A retaining means, such as the cylinder 26 holds the rollers in rolling contact with the lobes. A large lip 28 extending from one end of the cylinder 26 rests against a recessed rim 32 around the mouth of the handle end of the casing. A smaller lip 30 extending from the opposite end of the cylinder 26 hooks into a recessed groove 38 around the roller between the large and small diameter sections.

The larger diameter section 40 encounters a ridge 36 in the interior casing surface between the large working lobes 20 and smaller retaining lobes 42 to prevent the rollers from falling out of the handle end, while the retaining cylinder 26 prevents the rollers from falling out of the working end of the casing. The retaining cylinder which may be plastic fits with the larger lip 28 forming a continuous surface with the handle end face 55 of the casing, as seen in FIG. 5. The working ends of the rollers align with the working end face 19, as seen in FIG. 1.

Each roller is then free to roll within each pair of lobes so that when a stud shaft 60, in FIG. 5, is positioned within the casing in contact with the working ends of the rollers, a ramped camming action takes place within each lobe to lock the rollers around the stud shaft for a tight grip. The shaft may then be turned as desired to install or remove the stud. Naturally the gripper may be used on the heads of nuts or bolts and around any shaft-like connector which will fit within the rollers when gripping and turning is desired.

In FIG. 3 an alternate embodiment of the invention utilizes rollers 18A having equal diameters on both sections 34A and 40A of the roller with a recessed groove 38A between the two different sections. A rigid circular ring 50 fits within the grooves and interacts with an annular protrusion 46 forming a band around the interior surface of the casing to retain the rollers in place leaving them free to roll within the lobes 20 and 42A which are equal in this embodiment to interact with the equal roller sections. Both ends of the rollers align with both ends of the casing in this embodiment.

The rollers and casing are formed of high quality steel normally used in tools, although the retaining means may be fabricated of plastic.

It is understood that the preceding description is given merely by way of illustration and not in limitation of the invention and that various modifications may be made thereto without departing from the spirit of the invention as claimed.

We claim:

1. A stud gripper tool having open access axially through the tool so that the tool may slide down the stud to any desired length for gripping the stud at any desired point for removing or installing the stud, wherein the tool comprises:

an elongated, hollow tubular casing having a working end and a handle end and having an interior surface comprising at least one pair of stepped lobes axially aligned in a longitudinal relationship formed on the interior surface of the casing, wherein the lobe at the working end comprises a larger radius of curvature and intrudes into the interior surface further than the lobe at the handle end;

at least one elongated, axially extending, roller comprising a stepped shaft having a larger diameter cylindrical shaft portion at the working end in rolling contact with the larger and radius lobe, and a smaller diameter cylindrical shaft portion at the handle end in rolling contact with the smaller radius lobe, wherein the stepped shaft moves radially while moving circumferentially relative to the lobes, wherein a recess into the roller around the circumference of the roller separates the two shaft portions;

roller retaining means mounted within the casing in engagement with the recessed ring for maintaining the roller in rolling contact with the pair of stepped lobes, wherein the retaining means remains within circumferencial boundary limits of the larger diameter shaft portion of the roller to maintain a clear interior opening through the entire casing from the working end to the handle end to admit a stud therethrough, which stud may be approximately equal in diameter to the circumferencial boundary of the larger diameter shaft portion of the roller;

a handle receiving means on an exterior of the casing at the handle end to receive a handle means rigidly secured thereto for turning the casing;

wherein the larger diameter shaft portion of the roller is free to roll on the large radius lobe when the roller engages and tightens on a stud during turning of the casing.

2. The invention of claim 1 wherein the roller retaining means comprises a hollow cylinder slightly smaller in diameter than the boundary limits of the large diameter shaft portion of the roller, which hollow cylinder comprises a small externally protruding lip at one end for engaging the recess in the roller and a large externally protruding lip at an opposite end for engaging a recessed rim around the interior of the handle end of the casing, wherein the roller retaining means is positioned at the handle end of the casing engaging both the recess in the roller and the recessed rim of the casing to maintain the roller against the lobes and to prevent the roller from falling out of the working end of the casing, while a ridge formed in the interior surface of the casing between the lobe pair prevents the roller from falling out of the handle end of the casing.

3. The invention of claim 2 wherein the large lip of the roller retainer forms a continuous plane with a flat end surface on the handle end of the casing.

4. The invention of claim 1 wherein the roller retainer means comprises a ring which engages the recess on the roller on a side of the roller away from the interior surface of the casing to retain the roller against the lobe pair and an annular protrusion from the interior surface of the casing engages the recess on the roller on a side of the roller adjacent to the interior surface of the casing to prevent the roller from falling out of either end of the casing.

5. The invention of claim 4 wherein the cylindrical shaft portions of the roller are approximately equal in diameter.

6. The invention of claim 1 wherein the roller aligns with an end face of the casing at the working end of the casing.

7. The invention of claim 1 wherein the handle receiving means comprises surface variations around an exterior surface of the casing at the handle end.

8. The invention of claim 7 wherein the surface variations comprise a series of standard faces for receiving a wrench or like tool around the handle end of the casing.

9. The invention of claim 1 wherein the handle receiving means comprises a permanent connection to a handle rigidly secured to the casing.

10. The invention of claim 1 comprising at least three adjacent pair of lobes positioned around the interior surface of the casing and a stepped roller contacting each lobe pair.

11. The invention of claim 1 comprising a single pair of lobes and a stepped roller contacting the lobe pair, wherein he remaining inside surface of the casing is provided with a plurality of spaced axially extending flutes, ribs or teeth for gripping in cooperation with the roller and lobes.

* * * * *